US006993263B2

(12) United States Patent
Arimura

(10) Patent No.: US 6,993,263 B2
(45) Date of Patent: Jan. 31, 2006

(54) IMAGE FORMING APPARATUS

(75) Inventor: Koji Arimura, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 176 days.

(21) Appl. No.: 10/779,739

(22) Filed: Feb. 18, 2004

(65) Prior Publication Data

US 2004/0165900 A1 Aug. 26, 2004

(30) Foreign Application Priority Data

Feb. 24, 2003 (JP) ..... 2003-046116

(51) Int. Cl.
*G03G 15/02* (2006.01)
*G03G 15/00* (2006.01)

(52) U.S. Cl. ..... 399/50; 399/43; 399/167

(58) Field of Classification Search ..... 399/50, 399/43, 167

See application file for complete search history.

(56) References Cited

U.S. PATENT DOCUMENTS 4,561,762 A * 12/1985 Watanabe et al. ..... 399/167
6,014,529 A * 1/2000 Sato ..... 399/50

FOREIGN PATENT DOCUMENTS

JP 10-97122 4/1998

* cited by examiner

*Primary Examiner*—Susan Lee
(74) *Attorney, Agent, or Firm*—Fitzpatrick, Cella, Harper & Scinto

(57) ABSTRACT

An image forming apparatus includes a charging unit for charging an image bearing member, an image forming unit for forming a toner image on the image bearing member that has been charged, and a cleaning unit for contacting the image bearing member to clean the surface of the image bearing member. In the apparatus, a ratio of a period wherein the image bearing member is moved without being charged to a period wherein the image bearing member is moved while being charged, is controlled to be a predetermined value or greater.

4 Claims, 3 Drawing Sheets

FIG. 3

| No. | NUMBER OF SHEETS FOR PRINT | CHARGING PERIOD (SEC) | IDLE ROTATION PERIOD (SEC) | CHARGING : IDLE ROTATION | ADDITIONAL IDLE ROTATION PERIOD (SEC) |
|---|---|---|---|---|---|
| 1 | 1 | 4 | 7 | 4 : 7 | 0 |
| 2 | 1×100 | 400 | 700 | 4 : 7 | 0 |
| 3 | 10×10 | 310 | 70 | 4.5 : 1 | 0 |
| 4 | 25×4 | 304 | 28 | 10.9 : 1 | 32.8 |
| 5 | 50×2 | 302 | 14 | 21.6 : 1 | 46.4 |
| 6 | 100 | 301 | 7 | 43 : 1 | 53.2 |

CHARGING PERIOD UNDER CONTINUED CONDITION:
4 SEC FOR INITIAL SHEET, +3 SEC FOR NEXT ONE SHEET

PREDETERMINED NUMBER OF SHEETS: 100

PREDETERMINED RATIO (CHARGE/IDLE ROTATION): 5:1

IMAGE FORMING APPARATUS

BACKGROUND OF THE INVENTION

1. Field of the Invention

The present invention relates to an image forming apparatus, and in particular it is preferable applied to an image forming apparatus, such as an electrophotographic apparatus in which an image bearing member is repetitively used and a cleaning device is equipped for bringing a cleaning member into contact with an image bearing member and collecting a residual material, such as residual transfer toner, from the surface of the image bearing member.

2. Related Background Art

Various types of electrophotographic copiers have been in practical use. These copiers form an electrostatic latent image on the surface of an image bearing member, such as a photoconductive photosensitive member; clean the surface of the image bearing after the development process and the transfer process have been completed; and thereafter perform the latent image forming process again.

A system for bringing a flexible conductive roller into contact with an image bearing member and applying a high voltage in order to maintain a uniform potential for the image bearing member, i.e., a contact charging system, is practically employed for various image forming apparatuses.

Compared with a charging system that uses Colutron, the contact charging system can suppress the occurrence of ozone and can effectively prevent smearing of an image.

Recently, however, to extend the service lives of the image bearing members used for many image forming apparatuses, such methods have been employed that reduce an amount of the surface scraping to which the image bearing members are subjected, e.g., the surface hardness of an image bearing member is increased, the primary charging at a high voltage is not applied in a time period other than the image forming period, or even when the primary charging is applied, it is applied at a lower voltage in that time period.

This is because the amount of the scraping of an image bearing member is greater when a high voltage is applied to the surface of the image bearing member by a primary charging device, as compared when it is not applied.

However, the above described contact charging system is a method used to superimpose a direct-current voltage on an alternating-current voltage, and upon the application of a high voltage, a nitrogen oxide such as NOx, called a discharge product, is generated and is attached to the surface of the image bearing member. Furthermore, the amount of the discharge product that is attached is increased as the time for the discharge period is increased.

It is well known that the sliding performance of the image bearing member is greatly deteriorated due to the attached discharge product. Therefore, generally, a method is employed whereby a cleaning blade or a sponge roller, as a cleaning member, is brought into contact with the image bearing member and scrapes off the discharge product attached to the surface of the image bearing member, as well as scraping the surface of the image bearing member that is deteriorated as a result of the application of a high voltage during the primary charging.

However, for a conventional image forming apparatus that employs an image bearing member having a rough surface or an image bearing member of which an amount of scraping is reduced, a balance between the amount of the attached discharge product and the scraping function performed by the friction member cannot be kept, and the discharge product will remain on the surface of the image bearing member.

When the printing is restarted while discharge product remains on the surface of the image bearing member, the sliding performance of the cleaning blade across the image bearing member is deteriorated, and since contact by the cleaning blade is not uniform, so-called "chattering" occurs.

When the blade "chattering" occurs, it is difficult to efficiently scrape off the material attached to the surface of the image bearing member, and accordingly, the attached material accumulates more easily on the surface of the image bearing member. As a result, the sliding performance of the drum is gradually deteriorated due to the durability of the attached material, and finally, the contact portion of the blade is inverted and a so-called "warped" phenomenon occurs.

The present inventor eagerly studied means for coping with these conventional problems. An overview of the study performed will now be described.

Through experiments and a study of the experiments, the present inventor found that the ratio of the applying time period for charging to a time period (hereinafter referred to as an idle rotation period) other than the former time period, such as the delivery of transfer materials to the outside of the apparatus after the transfer process has been completed, has a correlation with the sliding performance of an image bearing member.

According to the view of the present inventor, this phenomenon is caused by the fact that a material, such as a discharge product generated during image forming, attached to the surface of the image bearing member is scraped off by a blade during the idle rotation period, wherein a new discharge product is not generated.

Specifically, in a mode where a ratio of the idle rotation period is comparatively large, such as a case where the intermittent printing of a small number of sheets is conducted, the sliding performance of the image bearing member is maintained, so it is kept close to the initial state until the service life of the image bearing member has expired. On the other hand, during continuous printing, a high voltage is always applied during the image forming, so that the ratio of the idle rotation period to the charging period is reduced. Therefore, in accordance with the durability of the relevant material, the performance of the sliding image bearing member is deteriorated.

Therefore, the present inventor has continued to study the process eagerly, and resolved that, to overcome the deterioration of the sliding performance of the surface of the image bearing member, the material attached to the surface of the image bearing member must be frequently scraped off before a predetermined amount is reached, and that the sliding of the image bearing member should be maintained.

On the other hand, when the ratio of the idle rotation period to the applying time period for charging regarding a rotation time period of the image bearing member is greater than a predetermined ratio, e.g., when the number of times of printings for each sheet is relatively large among a predetermined number of time of printings, it can be assumed that an attached material, such as a discharge product, is appropriately scraped off from the surface of the image bearing member by a cleaning blade. Therefore, an idle rotation period is not required.

SUMMARY OF THE INVENTION

It is one objective of the present invention to provide an image forming apparatus that can perform an appropriate cleaning operation, without causing a defect in a cleaning means that contacts an image bearing member.

To achieve this objective, an image forming apparatus according to the present invention comprises:

charging means for charging an image bearing member;

image forming means for forming a toner image on the image bearing member that has been charged;

cleaning means for contacting the image bearing member to clean the surface of the image bearing member; and control means adapted to a ratio of a period wherein the image bearing member is moved without being charged by the charging unit, to a period wherein the image bearing member is moved while being charged by the charging unit, to be a predetermined value or greater.

BRIEF DESCRIPTION OF THE DRAWINGS

FIG. 3 is a table showing example idle rotation modes for the image forming apparatus according to the embodiment of the present invention.

DETAILED DESCRIPTION OF THE PREFERRED EMBODIMENT

Figure 1:
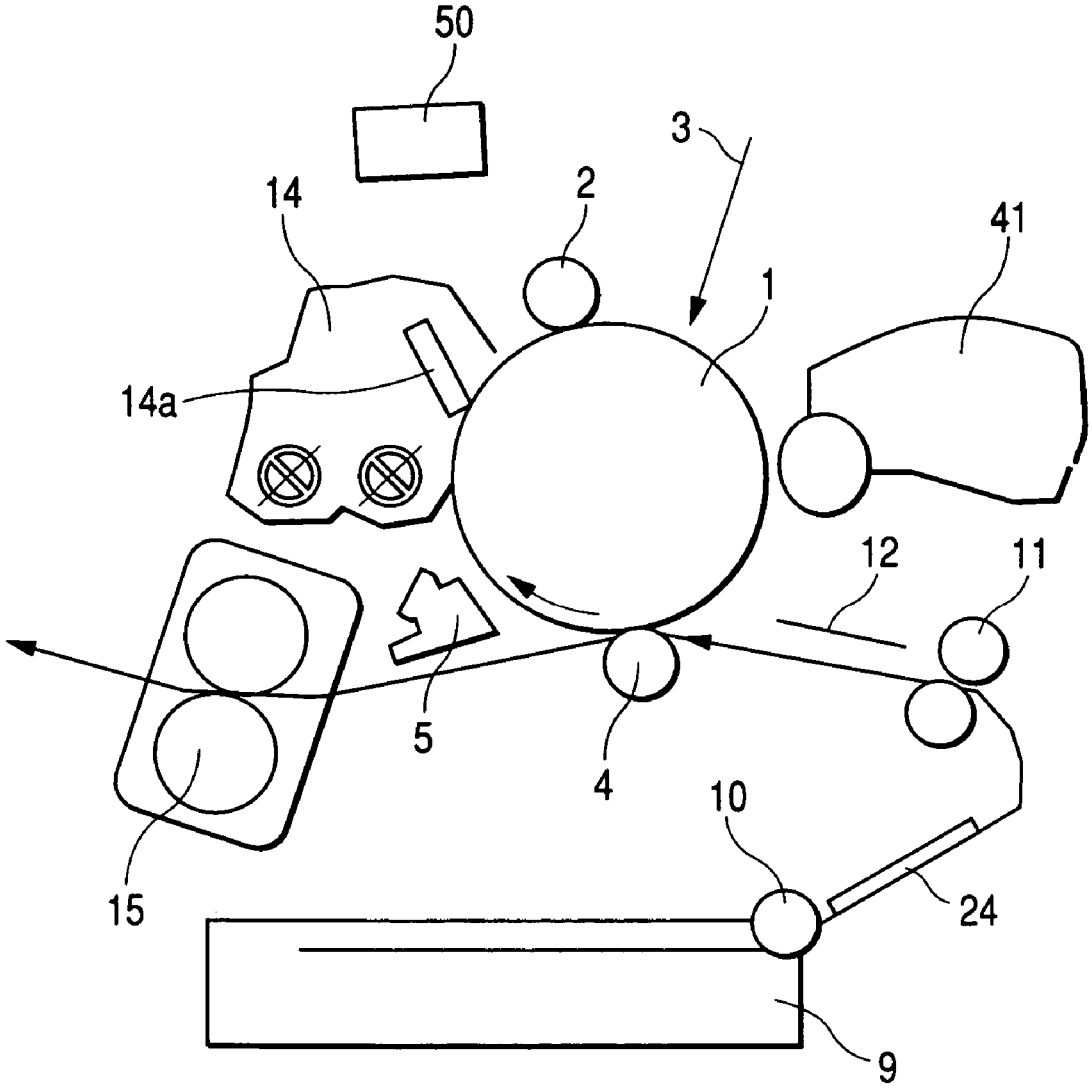
FIG. 1 is a schematic diagram showing the internal arrangement of an image forming apparatus according to one embodiment of the present invention.

One embodiment of the present invention will now be described while referring to the accompanying drawings. In all the drawings for this embodiment, the same reference numerals are used to denote identical or corresponding components.

First, an explanation will be given wherein a copier is an image forming apparatus according to the embodiment of the present invention. In FIG. 1, the schematic arrangement of the copier according to the embodiment of the present invention is shown.

As is shown in FIG. 1, for the image forming apparatus of this embodiment, an image bearing member 1 is provided as a member to be cleaned.

A primary charging device 2, as charging means, a developing device 41, as developing means, a transfer device 4, as transfer means, a separation device 5 and a cleaning device 14 having, as a residue removing means, a cleaning blade 14*a* are arranged in order around the image bearing member 1. The image bearing member 1 and the developing device 41 are driven by a motor (not shown), which is drive means.

Further, a charging period accumulation device, which serves as accumulation means for accumulating the number of printed sheets and the primary charging period during the printing operation, and an idle period accumulation device, which accumulates a period other than the primary charging period during the printing operation, i.e., a so-called idle rotation period, are provided for the image forming apparatus in this embodiment. The image forming apparatus also includes a ratio calculator, which serves as ratio calculation means for receiving information data accumulated by the accumulation device and for calculating a ratio based on the data; and a control mechanism for outputting an instruction signal for executing one idle rotation of the image bearing member 1. These accumulation devices, the ratio calculation means and the control mechanism are provided for a control device 50.

Furthermore, an optical system (not shown), for illuminating image exposure light 3 that corresponds to the image of a document obtained by scanning a document, onto the surface of the image bearing member 1 to is located above the image bearing member 1 of the image forming apparatus of this embodiment.

A paper cassette 9, which serves as a paper supply unit, is located the furthest upstream from the transfer device 4. A transfer material 24, which serves as a transfer medium, is fed from the paper cassette 9 by a feed roller 10 and a registration roller 11 and is conveyed to a transfer area.

A fixing device 15 is located downstream of the separation device 5, and downstream of the fixing device 15 is located a paper discharge unit that includes a discharge roller and a discharge tray (none of the three are shown) for discharging the transfer material 14 outside the apparatus.

In the thus arranged copier of the embodiment, first, the surface of the image bearing member 1 driven by the motor (not shown) is charged by the primary charging device 2. Thereafter, on to the area charged by the primary charging device 2 is illuminated the image exposure light 3, and thereby an electrostatic latent image is formed on the surface of the image bearing member 1.

The electrostatic latent image is developed by the developing device 41 to obtain a toner image, and as the image bearing unit 1 is rotated, the toner image reaches the transfer area. Concurrently, the transfer material 24 that has been fed is conveyed, by a registration roller 11, to the transfer area in synchronization with the toner image on the image bearing member 1. Then, the toner image is transferred to the transfer material 24 by the transfer device 4, which comprises a transfer roller.

The transfer material 24 to which the toner image has been transferred is separated from the image bearing member 1 by the separation device 5. Then, sequentially, the toner image is fixed to the transfer material 24 by the fixing device 15 and the resultant transfer material 24 is discharged outside the copier.

On the other hand, after the toner image has been transferred, developer remaining on the surface of the image bearing member 1 is scraped off by the cleaning blade 14*a* of the cleaning device 14 and is transferred to a waste toner container. To perform a continuous printing operation, the transfer materials 24 are sequentially conveyed to the transfer position at predetermined intervals and images are formed on their surfaces.

For an image forming apparatus that performs image forming (printing) in the above described manner, a predetermined number of sheets to be printed in this embodiment is defined as 100 sheets, for example, and a predetermined critical value for a ratio is defined as a charging period:an idle rotation period=5:1 (idle rotation period/charging period=⅕), for example. The charging period (applying time period for charging) id is a period during which the image bearing member 1 is rotated while being charged by the charging device 2, and the idle rotation period is a period during which the image bearing member 1 is rotated without being charged by the charging device 2. The number of sheets to be printed and the lower limit value of the ratio are merely examples, and arbitrary values can be set, depending on the image forming apparatus.

In this embodiment, the idle rotation of the image bearing member 1 is performed for the printing of each 100 sheets, so that the idle rotation period is not shorter than ⅕ time of the charging period. When the idle rotation period is equal to or longer than a predetermined number times the charging period, i.e., equal to or longer than ⅕ the time in this embodiment, the idle rotation of the image bearing member 1 is not performed and the printing operation is continued.

That is, for the image forming apparatus in this embodiment, first, as the printing operation is initiated, the charging period accumulation device detects, counts and accumulates the application period for the primary charging performed by the primary charging device 2, and in addition, the idle rotation accumulation device detects, counts and accumulates the idle rotation period being the rotation period of the image bearing member 1 except for the charging period. Then, based on these accumulation values, the control mechanism calculates a ratio for the idle rotation period to the charging period (idle rotation period/charging period).

When relative to a predetermined ratio the charging period is long, an idle rotation mode is performed, i.e., an additional idle rotation for the image bearing member 1 is performed at a predetermined timing until the above described lower limit (for example, ⅕) is reached.

Figure 2:
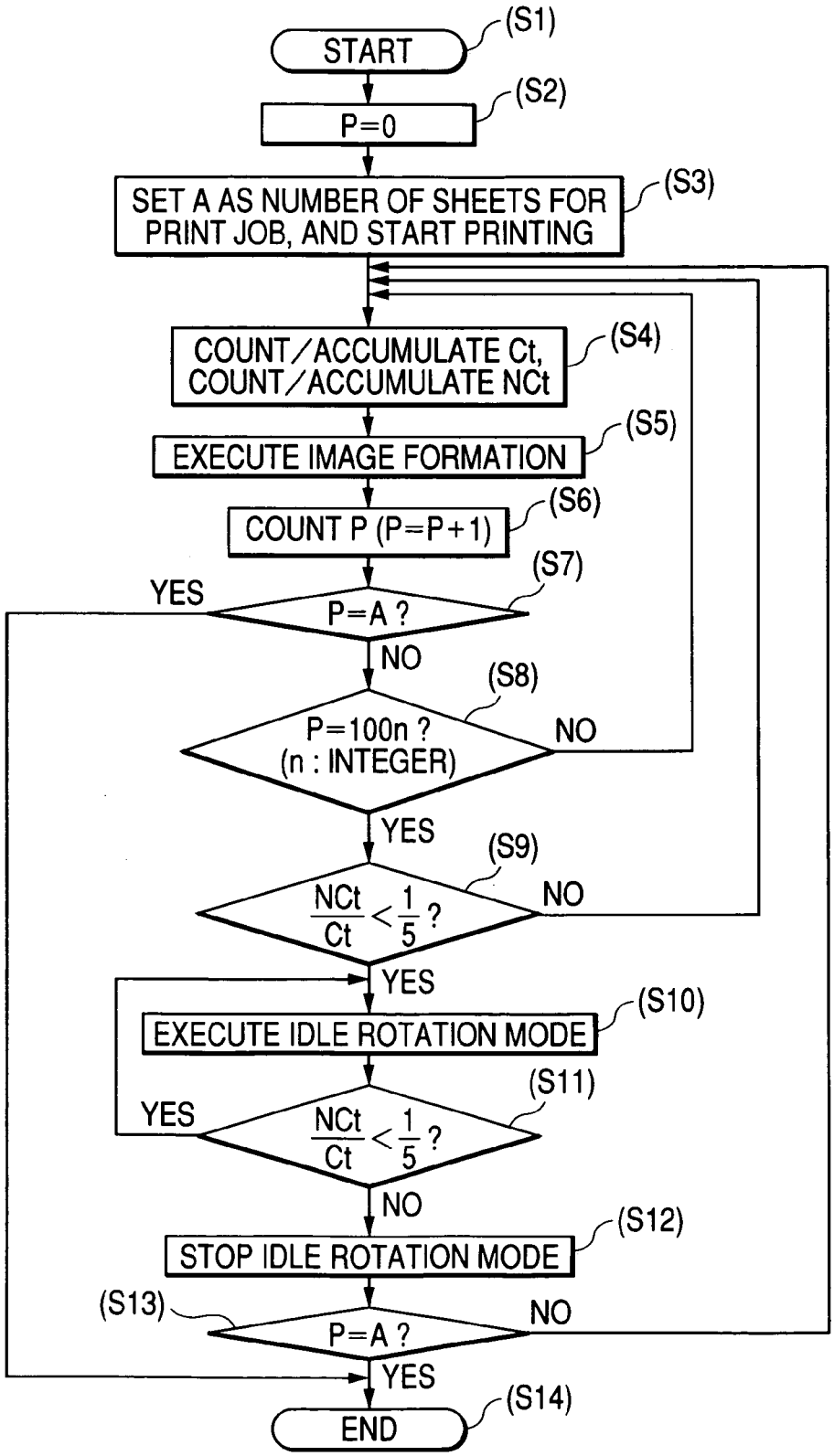
FIG. 2 is a flowchart for the present invention.

FIG. 2 is a flowchart showing the control processing.

When the operation is initiated (S1), first, the initial value for the number P of print sheets is set to zero (S2).

Then, the number of sheets for a print job is set to A (S3).

When the copier starts the operation, a charging period Ct and an idle rotation period Nct are counted and accumulated (S4), the image forming operation is performed (S5), and the number P of printed sheets is counted (S6).

When the number P of printed sheets reaches the predetermined A, the operation is halted (S7). And when the number P of printed sheets reaches the predetermined number 100 (integer times of 100) (S8), and the value of NCt/Ct is smaller than ⅕ (a predetermined critical value) (S9), the idle rotation mode is performed until ⅕ is exceeded (S10, S11 and S12). When the value of NCt/Ct is equal to or greater than ⅕ (a predetermined critical value) (S9), the idle rotation mode is not performed, and the image forming operation is continued.

Specifically, for the copier in this embodiment, at least one of a pre-rotation step, a post-rotation step and a paper feeding interval step, all of which are non-image forming periods, is selected, and at this step, the idle rotation mode for the image bearing member 1 is performed. The pre-rotation step is the rotation state of the image bearing member 1 before the image forming is begun, the post-rotation step is the rotation state of the image bearing member 1 after the image forming has been performed, and the paper-feeding interval step is the rotation state of the image bearing member 1 during the non-image forming period located between a plurality of image forming steps.

Examples for the printing operation and the idle rotation mode according to the embodiment are shown in FIG. 3.

As is shown in FIG. 3, in the image forming apparatus of this invention, when a predetermined number of sheets for image forming is 100, for example, the correlation between the number of sheets to be printed and the charging period and the idle rotation period is represented by a ratio of 4:7 for the charging period and the idle rotation period during the printing of one sheet, as is shown in Example No. 1 in FIG. 3.

As is shown in Example No. 2, even when the intermittent printing of one sheet is continued and the predetermined number, 100, is reached, the value of the idle rotation period/charging period is not lower than ⅕. Therefore, after a predetermined number of sheets has been printed, the image bearing member 1 does not enter the idle rotation mode and the additional idle rotation of the image bearing member 1 is not performed.

Similarly, as is shown in Example No. 3, even when the continuous printing operation for ten sheets has been performed ten times, the value of the idle rotation period/charging period is still ¼.5, and is not lower than ⅕. Therefore, the image bearing member 1 does not enter the idle rotation mode, and an additional idle rotation for the image bearing member 1 is not performed.

On the other hand, as is shown in Example No. 4, when a continuous printing operation for 25 sheets is performed four times, the idle rotation period/charging period is 1/10.9, and is less than ⅕, which is the constant ratio described above. In this case, the image bearing member 1 enters the idle rotation mode, and an additional idle rotation is performed so that the idle rotation period/charging period is equal to or greater than ⅕.

Specifically, the total printing period at this time is 332 seconds, and the ratio of the period for the charging performed by the charging device 2 and a period (an idle rotation period) for performing charging other than that performed by the primary charging device 2 is 10.9:1. Therefore, to obtain an idle rotation period/charging period that is equal to or greater than ⅕, $t \geqq 32.8$ is required as the additional idle rotation period t based on idle rotation period/charging period=(actual idle rotation period+additional idle rotation period (t))/charging period=$(28+t)/304 \geqq 1/5$.

That is, the image bearing member 1 is rotated for 32.8 seconds or longer in order to maintain the ratio at the constant value (⅕) or greater. Therefore, the idle rotation period/charging period can be maintained at the constant value or greater, i.e., ⅕ or greater in this embodiment.

Similarly, as is shown in Example No. 5, when a continuous printing operation for 50 sheets is performed two times, the image bearing member 1 need only be idly rotated for 46.4 seconds or longer, and as is shown in Example No. 6, when a continuous printing operation for 100 sheets is performed, the image bearing member 1 need only be idly rotated for 53.2 seconds or longer. Thus, the idle rotation period/charging period can be maintained at ⅕ or greater.

As the result of the performance of the idle rotation mode, it is confirmed that the durability is appropriately shifted, and that even when the printing of 10000 sheets is completed, the "warping" of the cleaning blade 14*a* does not occur. And when the durability test is continuously conducted in the same manner until 50000 sheets are printed, it is confirmed that the "chattering" or the "warping" of the cleaning blade 14*a* of the cleaning device 14 does not occur.

As is described above, according to the embodiment, when the idle rotation mode is set, it is confirmed that the "chattering" or the "warping" of the cleaning blade 14*a* of the cleaning device 14 can be prevented during the continuous printing. As a comparison with the embodiment, the same test is conducted under a condition wherein the idle rotation mode is not entered.

COMPARISON EXAMPLE 1

The durability example for a conventual image forming apparatus was conducted under the same condition as the above embodiment, except that the present invention was not employed, i.e., the idle rotation mode was not set. As a result, when about 200 sheets had been printed, "chattering" of the cleaning blade 14*a* of the cleaning device 14 occurred, and when about 1500 sheets had been printed, "warping" of the cleaning blade 14*a* occurred.

The embodiment of the present invention has been specifically explained. The present invention, however, is not limited to the above embodiment, and can be variously modified based on the technical concepts of the invention.

For example, the numerical values used in the embodiment are merely examples, and various other values can be employed as needed.

The present invention can be applied not only for the above described monochrome copier, but also for an arbitrary image forming apparatus, such as a printer, a facsimile machine or a full-color copier, that has a cleaning blade.

Furthermore, the present invention is not limited to the above described embodiment, and can include, within the scope of the invention, any combination of the above described technical concepts.

What is claimed is:

1. An image forming apparatus comprising:

charging means for charging an image bearing member;

image forming means for forming a toner image on the image bearing member that has been charged;

cleaning means for contacting the image bearing member to clean a surface of the image bearing member; and control means adapted to control a ratio of a period wherein the image bearing member is moved without being charged by the charging means, to a period wherein the image bearing member is moved while being charged by the charging means, so that the ratio is equal to or greater than a predetermined value, wherein the control means calculates the ratio in accordance with a predetermined number of sheets subjected to image forming.

2. An image forming apparatus comprising:

charging means for charging an image bearing member;

image forming means for forming a toner image on the image bearing member that has been charged;

cleaning means for contacting the image bearing member to clean a surface of the image bearing member; and control means adapted to control a ratio of a period wherein the image bearing member is moved without being charged by the charging means, to a period wherein the image bearing member is moved while being charged by the charging means, so that the ratio is equal to or greater than a predetermined value, wherein, when the ratio is smaller than a predetermined value, the control means is adapted to increase the period wherein the image bearing member is moved without being charged by the charging means, so that the ratio is equal to or greater than the predetermined value.

3. An image forming apparatus according to claim 2, wherein, in a period other than an image forming operation period, the control means performs an image bearing member moving mode for increasing the period wherein the image bearing member is moved without being charged by the charging means.

4. An image forming apparatus according to claim 3, wherein, when the ratio is equal to or greater than the predetermined value, the control means does not execute the image bearing member moving mode.

* * * * *

UNITED STATES PATENT AND TRADEMARK OFFICE

CERTIFICATE OF CORRECTION

PATENT NO. : 6,993,263 B2
APPLICATION NO. : 10/779739
DATED : January 31, 2006
INVENTOR(S) : Koji Arimura It is certified that error appears in the above-identified patent and that said Letters Patent is hereby corrected as shown below:

COLUMN 1:

Line 45, “above described” should read --above-described--.

COLUMN 2:

Line 63, “time” should read --times--.

COLUMN 4:

Line 51, “above described” should read --above-described--; and
Line 57, “id” should be deleted.

COLUMN 5:

Line 20, “above” should read --above- --.

COLUMN 6:

Line 7 is ¼.5,” should read --¼.5,--; and
Line 13, “is 1/10 .9,” should read -- 1/10.9 ,--.

UNITED STATES PATENT AND TRADEMARK OFFICE

CERTIFICATE OF CORRECTION

PATENT NO. : 6,993,263 B2
APPLICATION NO. : 10/779739
DATED : January 31, 2006
INVENTOR(S) : Koji Arimura It is certified that error appears in the above-identified patent and that said Letters Patent is hereby corrected as shown below:

COLUMN 7:

Line 11, "above described" should read --above-described--;
Line 15, "above described" should read --above-described--; and
Line 16, "above' should read --above- --.

Signed and Sealed this

Twenty-second Day of August, 2006

JON W. DUDAS
*Director of the United States Patent and Trademark Office*